US007156779B2

(12) United States Patent
Rudell et al.

(10) Patent No.: US 7,156,779 B2
(45) Date of Patent: Jan. 2, 2007

(54) POWER UNIT FOR JUMPING ROPE

(75) Inventors: Elliot Rudell, Torrance, CA (US); George T. Foster, Long Beach, CA (US); Ian Osborne, Gardena, CA (US)

(73) Assignee: Rudell Design, Torrance, CA (US)

( * ) Notice: Subject to any disclaimer, the term of this patent is extended or adjusted under 35 U.S.C. 154(b) by 8 days.

(21) Appl. No.: 10/897,629

(22) Filed: Jul. 23, 2004

(65) Prior Publication Data

US 2005/0164846 A1 Jul. 28, 2005

Related U.S. Application Data

(63) Continuation-in-part of application No. 10/688,636, filed on Oct. 16, 2003, which is a continuation-in-part of application No. 10/627,529, filed on Jul. 25, 2003.

(60) Provisional application No. 60/540,884, filed on Jan. 29, 2004.

(51) Int. Cl.
*A63B 21/00* (2006.01)

(52) U.S. Cl. ..... 482/81; 482/82

(58) Field of Classification Search ..... 482/81, 482/82; 446/247–249, 236–231
See application file for complete search history.

(56) References Cited

U.S. PATENT DOCUMENTS

| | | | | |
|---|---|---|---|---|
| 4,529,195 | A * | 7/1985 | Stevens | 482/4 |
| 4,739,985 | A * | 4/1988 | Rudell et al. | 482/81 |
| 5,496,204 | A * | 3/1996 | Brown et al. | 446/236 |
| 5,888,179 | A * | 3/1999 | Singhal | 482/81 |
| 5,931,766 | A * | 8/1999 | Cooper | 482/81 |
| 6,634,994 | B1 * | 10/2003 | Reid et al. | 482/81 |
| 6,726,604 | B1 * | 4/2004 | Verdun | 482/81 |

* cited by examiner

*Primary Examiner*—Jerome Donnelly
(74) *Attorney, Agent, or Firm*—Ben J. Yorks; Irell & Manella LLP

(57) ABSTRACT

An apparatus that moves a jumping element. The apparatus includes a motorized hub that is attached to a housing. The hub can rotate a jumping element, such as a jump rope, about a horizontal axis and/or a vertical axis. The hub is connected to a motor. The jump rope is coupled to the hub by a crank arm. The crank arm automatically releases from the arm in response to a threshold force. The apparatus includes a deactivation element that deactivates the motor when the jumping element is released from the hub. The jump rope can be coupled to the hub by a strap that limits the movement of the rope when decoupled from the hub. Deactivating the motor terminates rotation of the hub to prevent further movement of the crank arm and rope.

34 Claims, 15 Drawing Sheets

POWER UNIT FOR JUMPING ROPE

REFERENCE TO CROSS-RELATED APPLICATION

This application is a continuation-in-part of application Ser. No. 10/688,636 filed on Oct. 16, 2003, pending, which is a continuation-in-part of application Ser. No. 10/627,529, filed Jul. 25, 2003, pending. This application also claims priority to Application No. 60/540,884 filed on Jan. 29, 2004.

BACKGROUND OF THE INVENTION

1. Field of the Invention

The present invention relates to an apparatus that can automatically rotate a jump rope.

2. Prior Art

U.S. Pat. No. 4,739,985 issued to Rudell et al., discloses a motorized unit that can automatically rotate a jump rope. The motorized unit includes a motorized rotating hub that can be coupled to one end of a jump rope. The hub can be coupled to a pedestal so that the jump rope can rotate about a horizontal axis. The other end of the jump rope can be attached to a post or other stationary object. The apparatus allows the players to "jump rope" without manually swinging the rope. The apparatus also has a vertical mode wherein a hub platform is laid on the ground and the rope swings about a vertical axis. A player(s) then jumps over the swinging rope.

The Rudell motorized unit has an on/off switch located on the hub platform. Unfortunately, it is difficult to reach the platform and turn off the switch while jumping rope. The patent addresses this issue by describing a wireless transmitter that can be worn by the user to turn the motorized hub on and off. Wireless transmitters add to the cost of the product and are susceptible to damage, thereby rending the apparatus inoperative. The patent also describes the use of a pull string, but the string may become entangled with the rope.

The owner of the '985 patent had developed a product that included a timer. The timer would control the time interval at which the motorized hub would be active. Unfortunately, the user had no indication of when the motor was to start or end. Additionally, there is not indication of the speed of the motor.

The jump rope is attached to a crank arm of the Rudell motorized unit. To prevent injury it would be desirable to have the crank arm release from the hub in response to a threshold force, typically applied by the user. It would also be desirable to limit the movement of the released crank arm and jump rope to prevent these objects from flying and injuring participants.

There have been marketed a number of jump rope games such as SKIP-IT, TWIRL N JUMP, SKIP STICK and STICK-N-ROPE that all required manual activation of the rope.

BRIEF SUMMARY OF THE INVENTION

An apparatus that can move a jumping element. The apparatus includes a motor that is attached to a housing and coupled to a hub. The hub is adapted to be coupled to the jumping element. The apparatus includes a deactivation element that deactivates the motor when the jumping element is released from the hub.

DETAILED DESCRIPTION

Disclosed is an apparatus that moves a jumping element. The apparatus includes a motorized hub that is attached to a housing. The hub can rotate a jumping element, such as a jump rope, about a horizontal axis and/or a vertical axis. The hub is connected to a motor. The jump rope is coupled to the hub by a crank arm. The crank arm automatically releases from the arm in response to a threshold force. The apparatus includes a deactivation element that deactivates the motor when the jumping element is released from the hub. The jump rope can be coupled to the hub by a strap that limits the movement of the rope when decoupled from the hub. Deactivating the motor terminates rotation of the hub to prevent further movement of the crank arm and rope.

Figure 1:
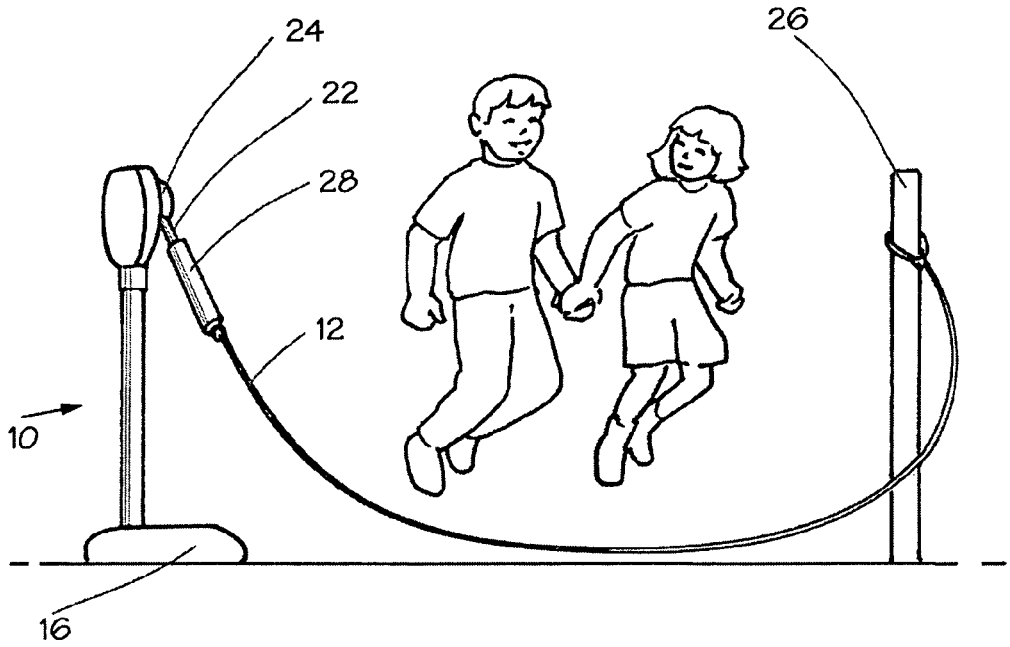
FIG. 1 is a perspective view showing players using an apparatus that swings a jump rope.
Figure 2:
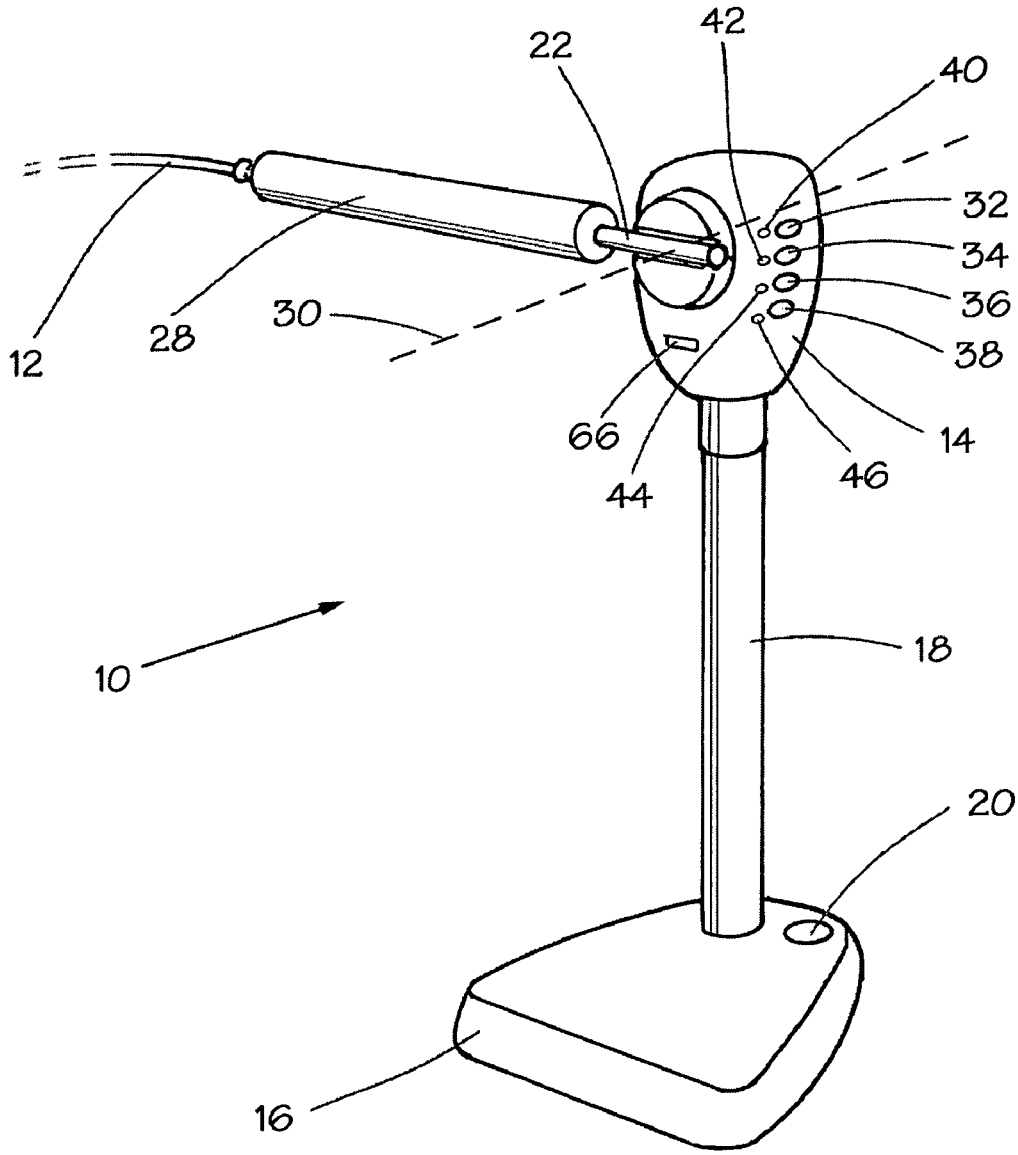
FIG. 2 is a perspective view showing a motorized rotating hub of the apparatus.

Referring to the drawings more particularly by reference numbers, FIGS. 1 and 2 show an apparatus 10 that can swing a jumping element 12. The jumping element 12 may be constructed as a jump rope. The apparatus 10 includes a hub platform 14 that is coupled to a horizontal base 16 by a pedestal 18. The horizontal base 16 may have a port 20 that allows the base 16 to be filled with water or sand to weigh down the apparatus 10.

The apparatus 10 may further include a crank arm 22 that is coupled to a rotating hub 24. The crank arm 22 may be attached to one end of the jump rope 12. The other end of the rope 12 may be attached to a post 26 or other stationary structure. The crank arm 22 may have a protective sleeve 28 constructed from an impact absorbing material such as a soft foam.

The hub 24 may rotate about a horizontal axis 30 to swing the rope 12 in an automated manner. The hub platform 14 may include buttons 32, 34, 36 and 38 that can be depressed by a user to set the time interval and/or speed control for rotation of the hub 24. Each button 32, 34, 36 and 38 has a corresponding indicator 40, 42, 44 and 46 that provides an indication of the time interval and/or speed control selected by the user. The indicators 40, 42, 44 and 46 may be light emitting diodes (LEDs).

By way of example, button 32 and indicator 40 may be associated with a 1 minute interval, button 34 and indicator 42 may correspond to a 3 minute interval, button 36 and indicator 44 a 5 minute interval, and button 38 and indicator 46 a 10 minute interval. The platform surface may have indicia adjacent to the indicators that provide the corresponding numerical value. By way of example, depressing button 36 will cause the hub 24 to rotate for 5 minutes. Illumination of the indicator 46 will allow the user to determine which interval was selected. Alternatively, one of the buttons may be an on/off switch and the other buttons may be used to select the speed of hub rotation. For example, button 32 may slow the motor down and button 34 may speed the motor up.

Figure 3:
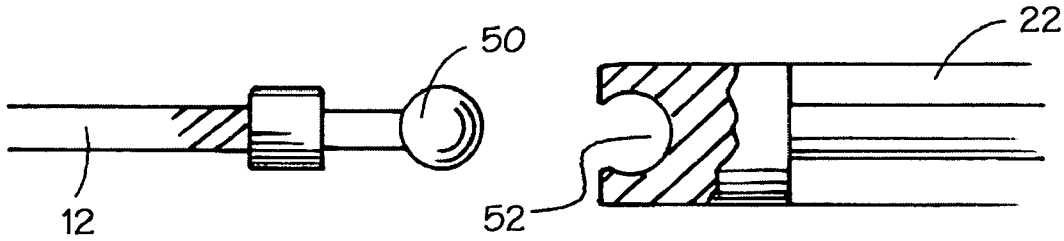
FIG. 3 is a side view showing the coupling of a jump rope to a crank arm.
Figure 4:
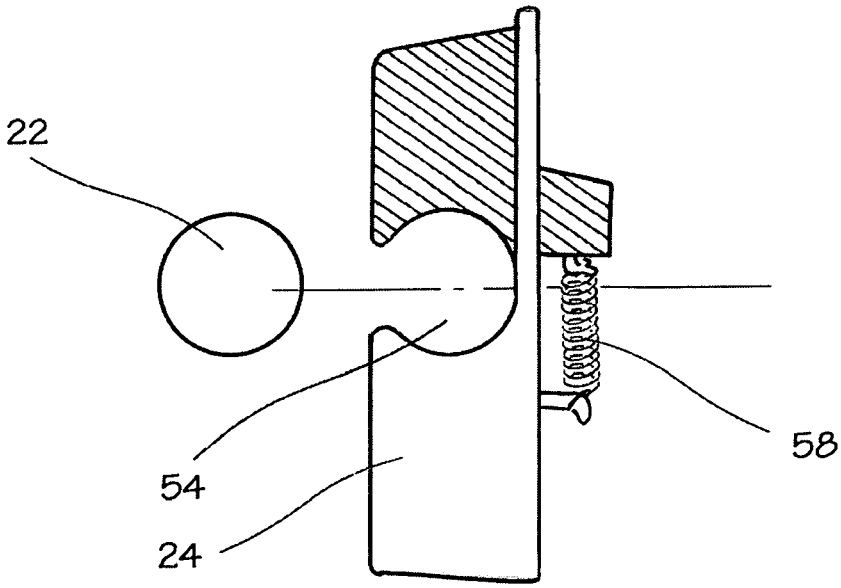
FIG. 4 is a side view of a spring biased hub.
Figure 5:
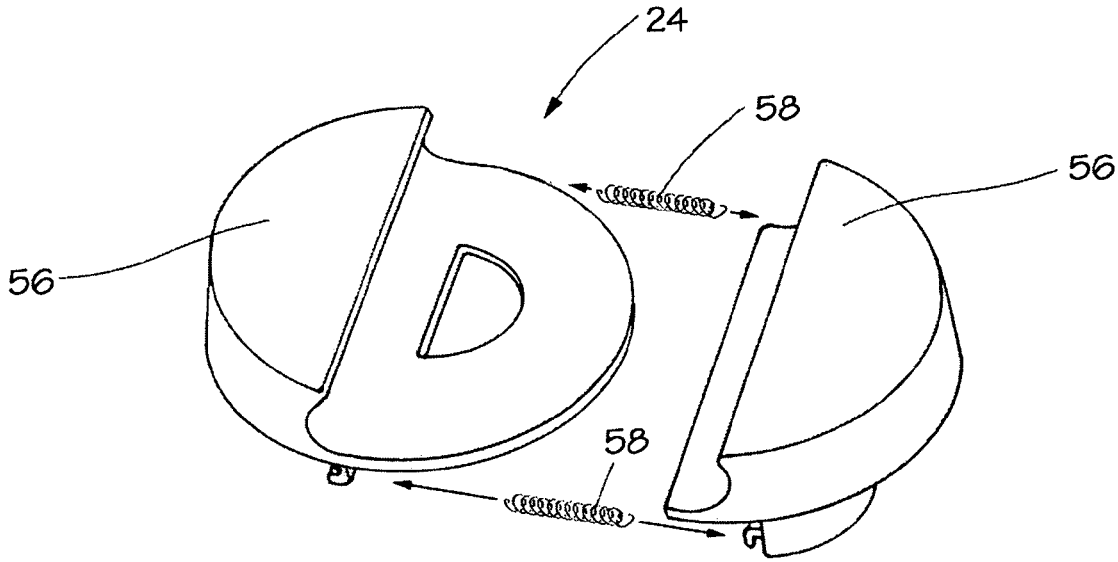
FIG. 5 is an exploded view of the spring biased hub.

As shown in FIG. 3 the jump rope 12 may have a ball 50 that can snap into a corresponding slot 52 in the crank arm 22. This allows the user to easily attach and detach the rope 12 from the arm 22. Likewise, as shown in FIG. 4, the hub 24 may have a corresponding slot 54 that receives the crank arm 22. As shown in FIG. 5, the hub 24 may be assembled from two half pieces 56 coupled together by springs 58. The springs 58 may bias the pieces 56 into a closed position and exert a spring force that retains the crank arm 22 within the hub slot 54. The crank arm 22 is released from the hub 24 when a force is applied to the arm that exceeds the spring force.

Figure 6:
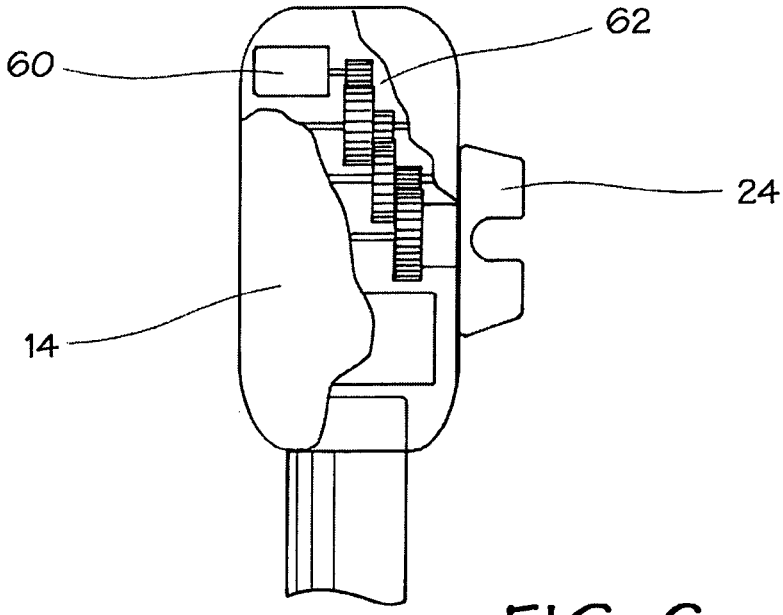
FIG. 6 is a sectional view showing a motor and gear assembly of the apparatus.
Figure 7:
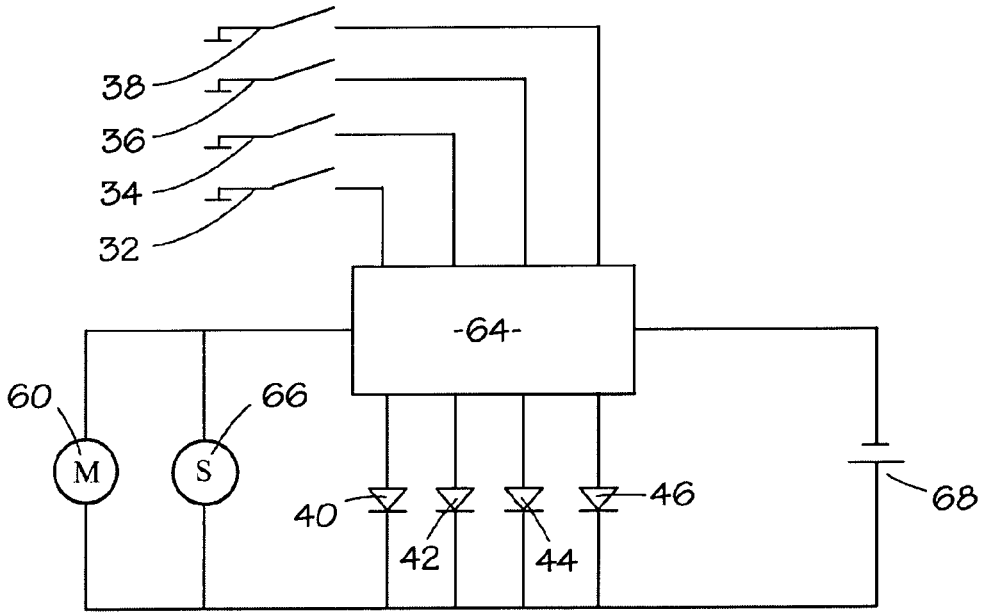
FIG. 7 is a schematic of an electrical system of the apparatus.

FIG. 6 shows an embodiment of a hub platform 14 that contains a motor 60 coupled to the hub 22 by a gear assembly 62. FIG. 7 shows an embodiment of an electrical circuit for the apparatus. The circuit may include a timer 64 that controls activation of the motor 60. The timer 64 may be a controller circuit that receives input from buttons 32, 34, 36 or 38 and can illuminate indicators 40, 42, 44 or 46. The timer 64 may also drive a speaker 66 or other sound generating device (see also FIG. 2). All of the electrical circuits and devices may be powered by a battery 68.

In operation, the user depresses one of the buttons 32, 34, 36 or 38 to set the time interval of operation. Alternatively, the buttons 32, 34, 36 or 38 may set the speed of the motor 60. Upon selecting a button the timer 64 begins a count until the motor 60 is activated. The timer 64 may drive the speaker 66 to emit a sound such as a beeping sound to indicate that the motor 60 is about to be activated. The timer 64 can also illuminate an indicator that corresponds to the selected button.

At the end of the count the timer 64 activates the motor 60. The timer 64 may begin another count that corresponds to the selected time interval. At the end of the time interval the timer 64 deactivates the motor 60. The timer 64 may cause the indicator to flash to indicate to the user that the motor is about to be deactivated.

Figure 8:
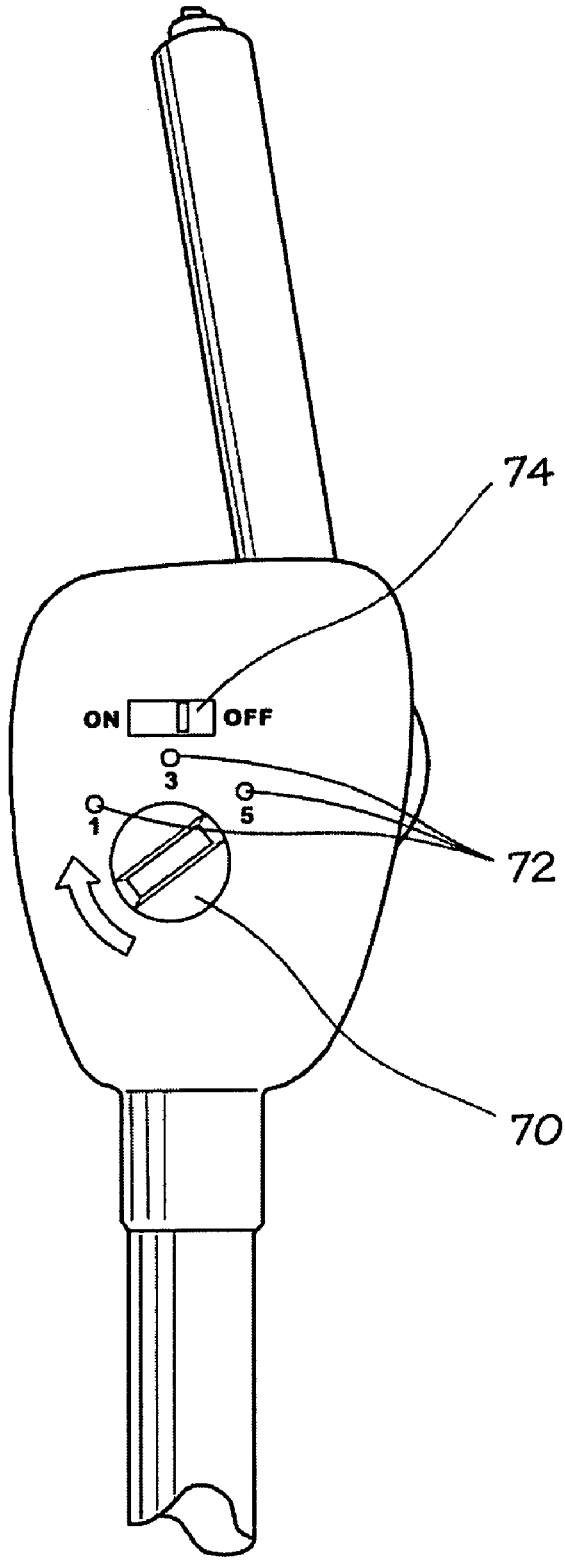
FIG. 8 is a perspective view of an alternate embodiment of the apparatus.

FIG. 8 shows an alternate embodiment of an apparatus that has a mechanical switch 70 for setting the time interval of the motor. The switch 70 may have discrete settings with corresponding light indicators 72 that are illuminated to indicate the selected time interval. The apparatus may also have a separate on/off switch 74.

Figure 9:
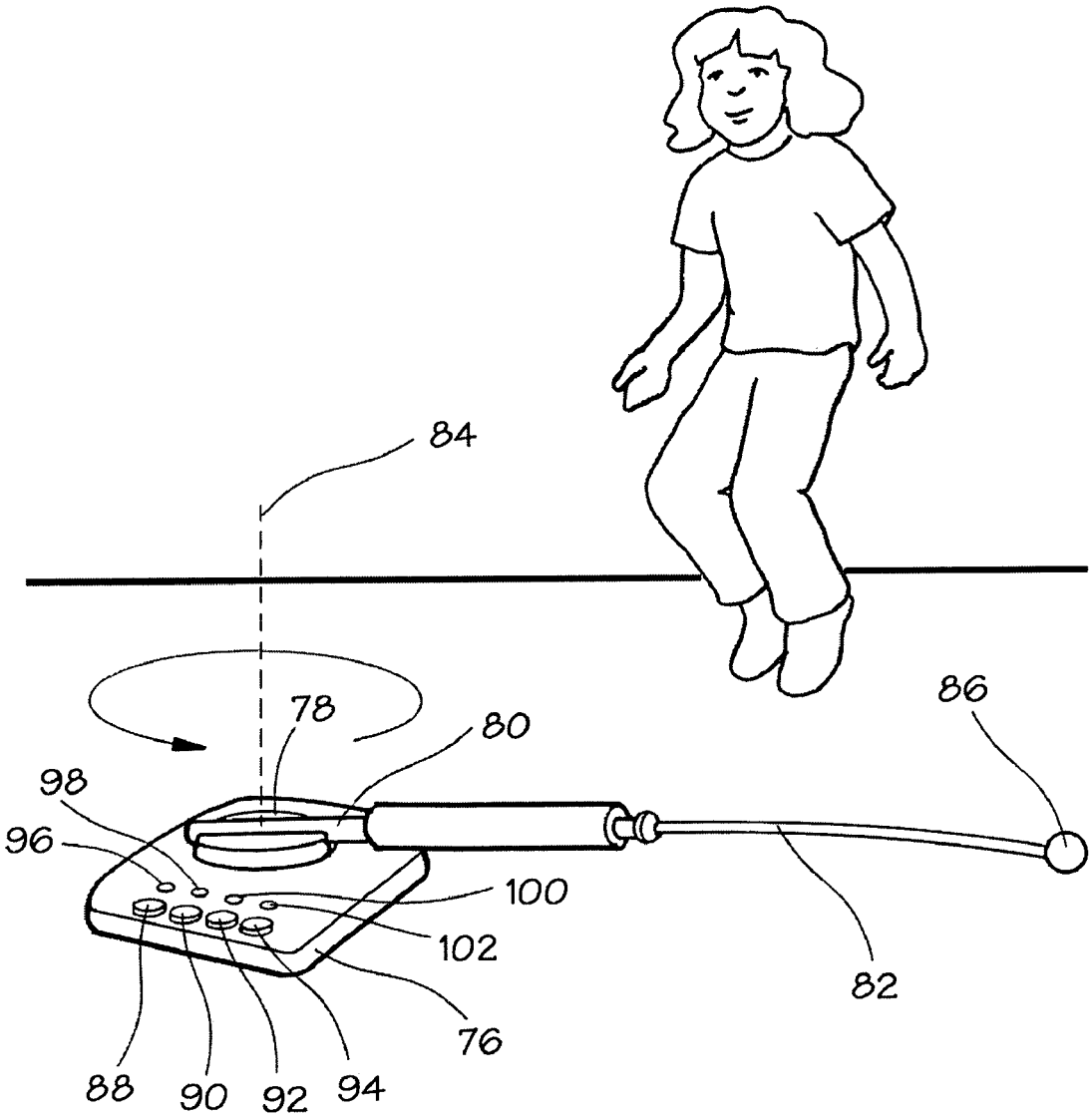
FIG. 9 is a perspective view of an alternate embodiment of an apparatus that operates in a vertical mode.

FIG. 9 is an alternate embodiment of an apparatus that can be operated in a vertical mode. A hub platform 76 is placed on a surface so that a hub 78 rotates a crank arm 80 and a jumping element 82 about a vertical axis 84.

In operation the user can select a time interval or speed by depressing one of the buttons 88, 90, 92 or 94, which causes an illumination of an indicator 96, 98, 100 or 102. An internal timer counts down a certain time interval, providing an audible indication of the impending activation of the motor. This allows the user to position themselves to jump over the rope when the motor is activated. The motor is then activated for the selected time interval. The automatic deactivation of the motor at the end of the time intervals allows the player to discontinue play without having to reach the hub platform 76. Ball 86, attached to jumping element 82, provides both a visual indication as to the position of the rotating jumping element, and also provides a weight mass to stabilize the jumping element as it rotates.

Figure 10:
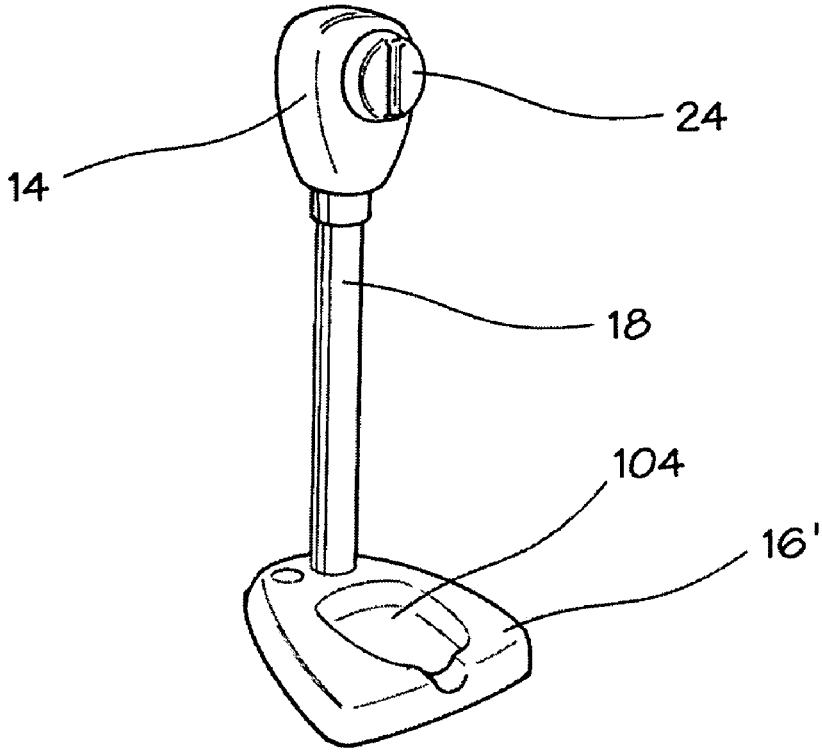
FIG. 10 is a perspective view of an alternate embodiment of an apparatus that can operate in both a horizontal mode and a vertical mode.
Figure 11:
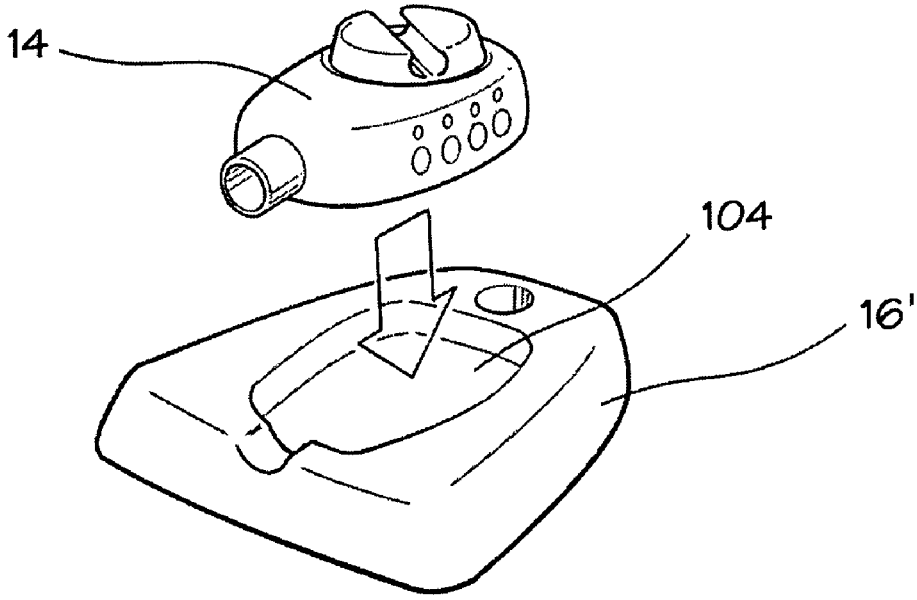
FIG. 11 is a perspective view showing a hub platform being coupled to a vertical mode base.

FIGS. 10 and 11 show an embodiment wherein the hub platform 14 can be located in a horizontal mode or placed in a horizontal position for use in a vertical mode. The base 16' may have a cavity 104 that receives the hub platform 14 for use in the vertical mode.

Figure 12:
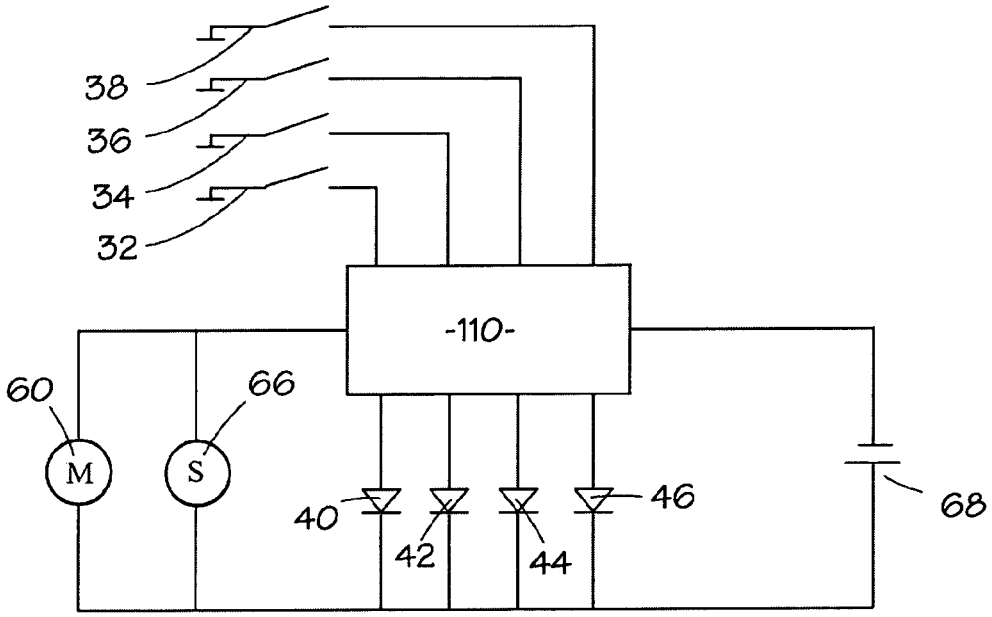
FIG. 12 is a schematic of an alternate embodiment of the apparatus.

FIG. 12 is an alternate embodiment wherein the motor 60 is controlled by a variable speed regulator 110. The regulator 110 is connected to buttons 32, 34, 36 and 38, and indicators 40, 42, 44 or 46. The user can change the speed of the motor 60 by depressing one of the buttons 32, 34, 36 or 38. The selected speed is indicated by the illumination of one or more of the indicators 40, 42, 44 and 46. The indicators 40, 42, 44 and 46 may also have indicia that allows the user to read the selected speed. For example, the indicia may be "slow", "medium", "fast" and "very fast" associated with the buttons 32, 34, 36 and 38, and indicators 40, 42, 44 and 46, respectively. The apparatus may be constructed so that the motor speed increases every time button 32 is depressed and decreases when button 34 is depressed.

Figure 13:
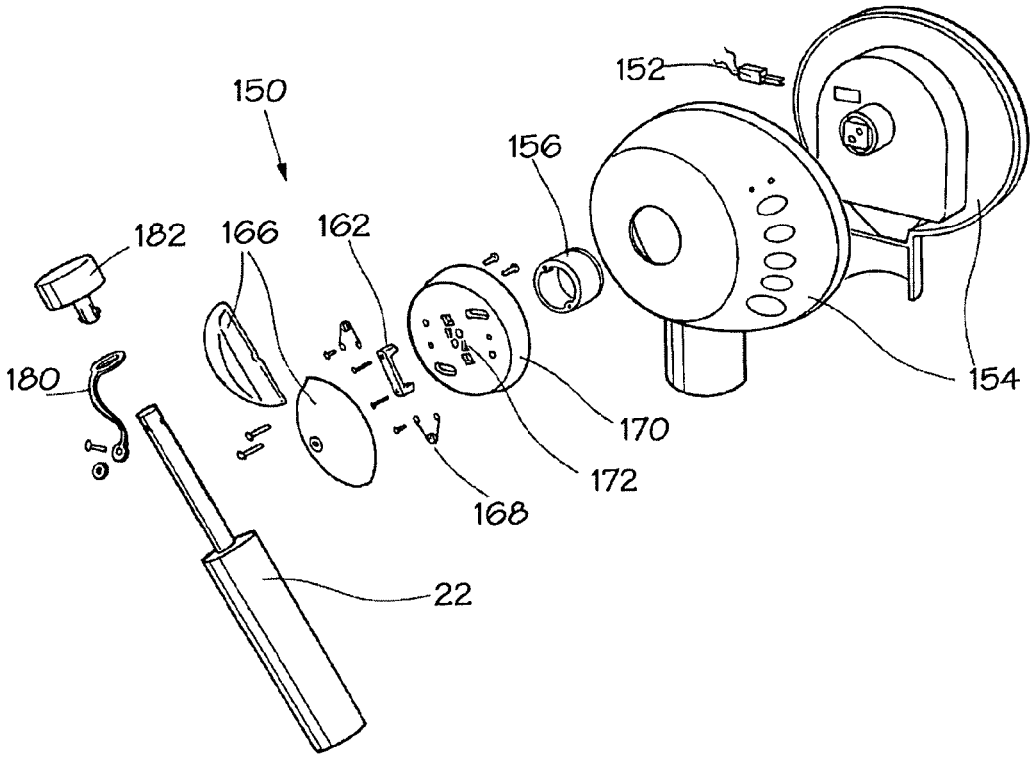
FIG. 13 is an exploded view of an alternate embodiment of a hub.
Figure 14:
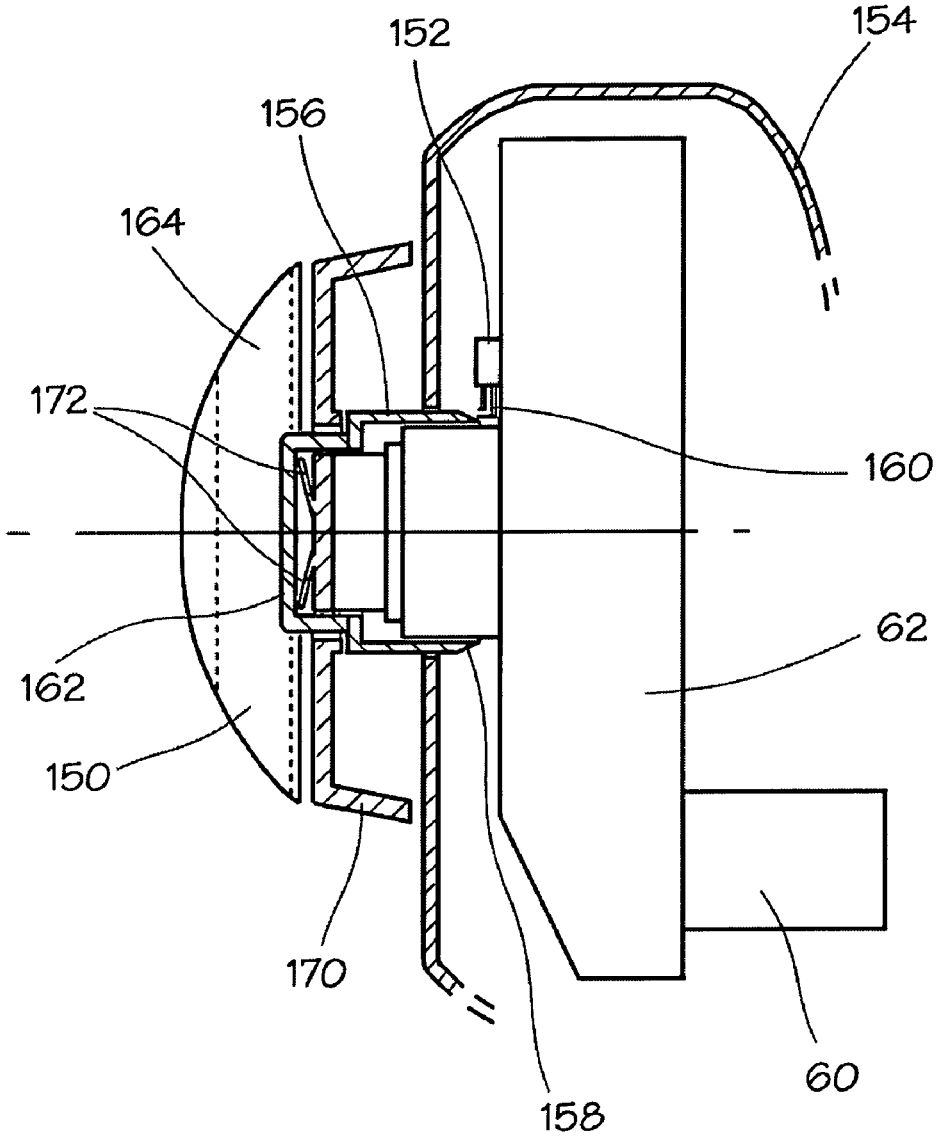
FIG. 14 is a side sectional view of the hub shown in FIG. 13.

FIGS. 13 and 14 show another embodiment of a hub 150 that deactivates the motor 60 when the crank arm 22 becomes detached from the hub 150. The apparatus may include a deactivation element 152 located within a housing 154. The deactivation element 152 may be a proximity switch that can deactivate the motor 60.

The hub 150 may include a slidable collar 156 that can be pushed into contact with the deactivation element 152. Contact between the collar 156 and the element 152 activates the motor 60. The collar 156 may have tapered surfaces 158 that allow for a cam movement of a deactivation element plunger 160. The element 152 deactivates the motor 60 when the plunger 160 is in an extended position.

The collar 156 may include a bar 162 that extends into a slot 164 of the hub 150. The hub 150 may include two separate pieces 166 coupled together by springs 168 and function in the same manner as the hub shown in FIG. 5. The bar 162 extends through a hub plate 170 that has a spring 172. The spring 172 biases the collar 156 away from the deactivation element 152.

Figure 15:
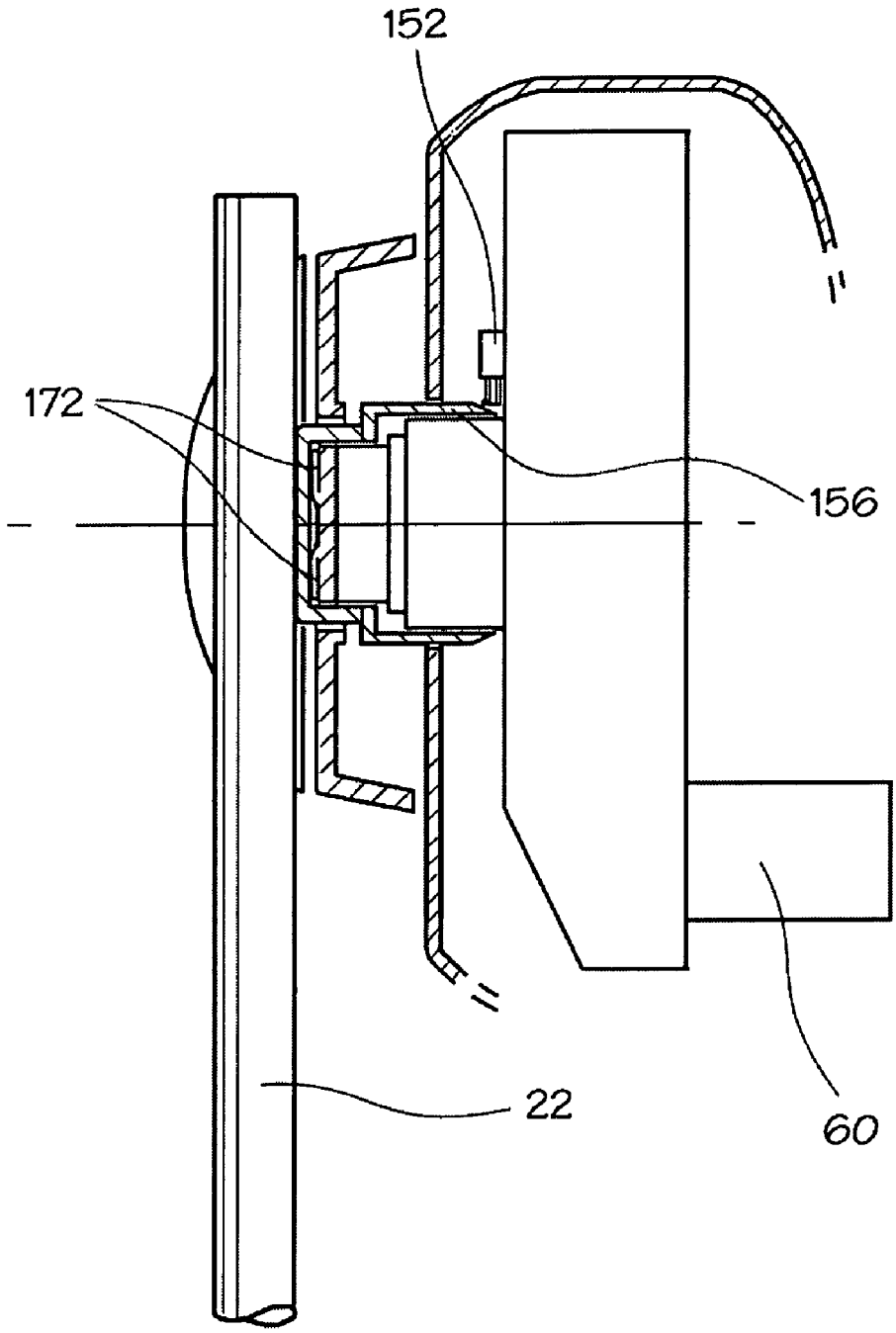
FIG. 15 is a side sectional view showing a crank arm inserted into the hub.

As shown in FIG. 15, when the crank arm 22 is within the hub slot 164 the arm 22 pushes the collar 156 into contact with the deactivation element 152. The motor 60 can be activated so that the user can energize the apparatus through the buttons, etc. When the crank arm 22 is released from the hub 150 the spring 172 pushes the collar 156 away from the deactivation element 152. The deactivation element 152 then deactivates the motor 60. Thus if the jump rope strikes the user with a force that causes the crank arm 22 to be pulled out of the hub slot the deactivation element 152 deactivates the motor 60 so that the hub 150 does not keep spinning.

Figure 16:
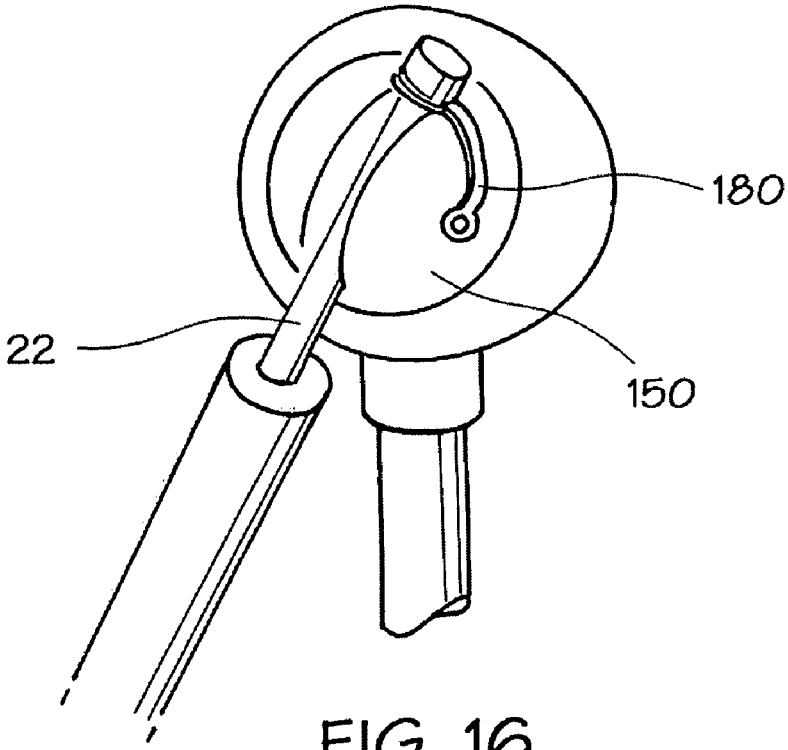
FIG. 16 is a front perspective view showing a strap attached to a crank arm and a hub.
Figure 17:
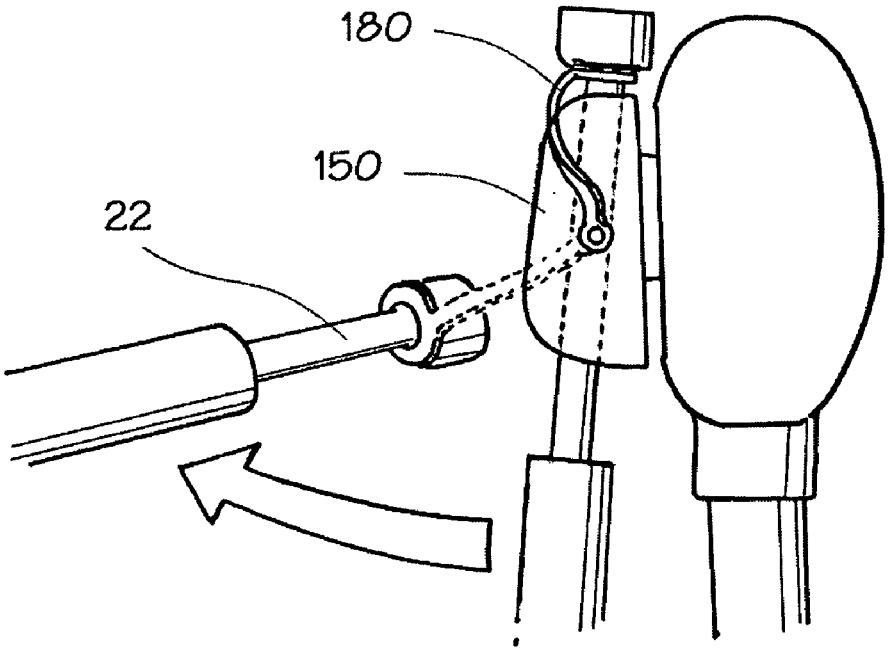
FIG. 17 is a side view showing the strap depicted in FIG. 16.

The apparatus may include a strap 180 that prevents the crank arm 22 and jump rope 12 from flying away when the arm 22 is released from the hub 150. As shown in FIGS. 16 and 17, the strap 180 may be attached to the crank arm 22 and the hub 150. The strap 180 may be captured by a detachable end cap 182 (shown in FIG. 13). When the crank arm 22 is pulled out of the hub the strap 180 limits the movement of the jump rope and the arm. Limiting rope and arm movement improves the safety of the device. Deactivation of the motor also improves safety by discontinuing rotation of the rope 12 even though the crank arm 22 is still attached to the hub 150 by the strap 180. Deactivating the motor 60 also conserves power.

Figure 18:
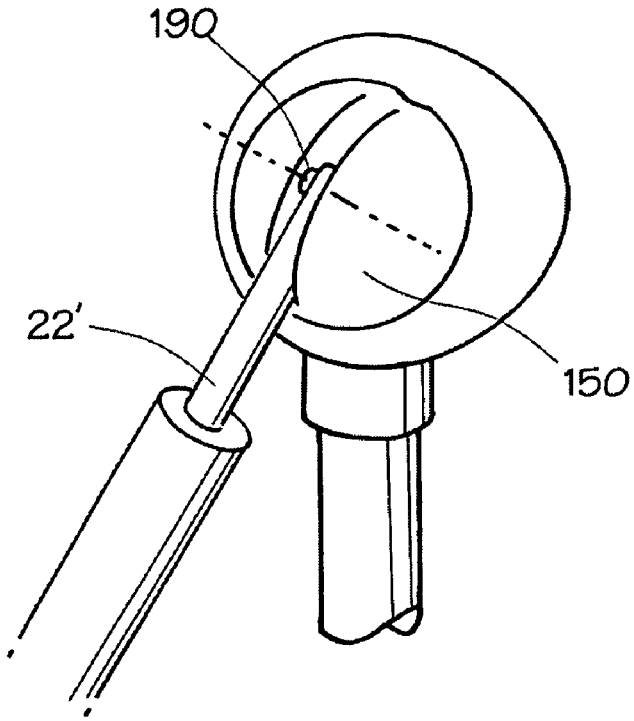
FIG. 18 is a front perspective view showing an alternate embodiment of a hub with a pivoting pin.
Figure 19:
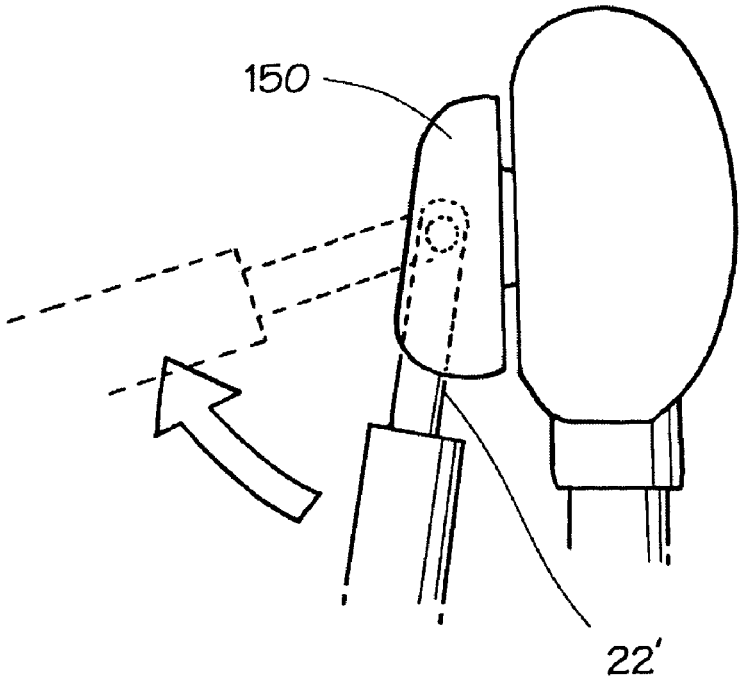
FIG. 19 is a side view of the hub shown in FIG. 18.

As shown in FIGS. 18 and 19, the hub may be configured to have a pin 190 that extends through a corresponding aperture (not shown) of the crank arm 22'. The pin 190 allows the arm 22' and adjoining rope to be pivoted relative to the hub. This allows the user to adjust the height or loop length of the jump rope when in use.

Figure 20:
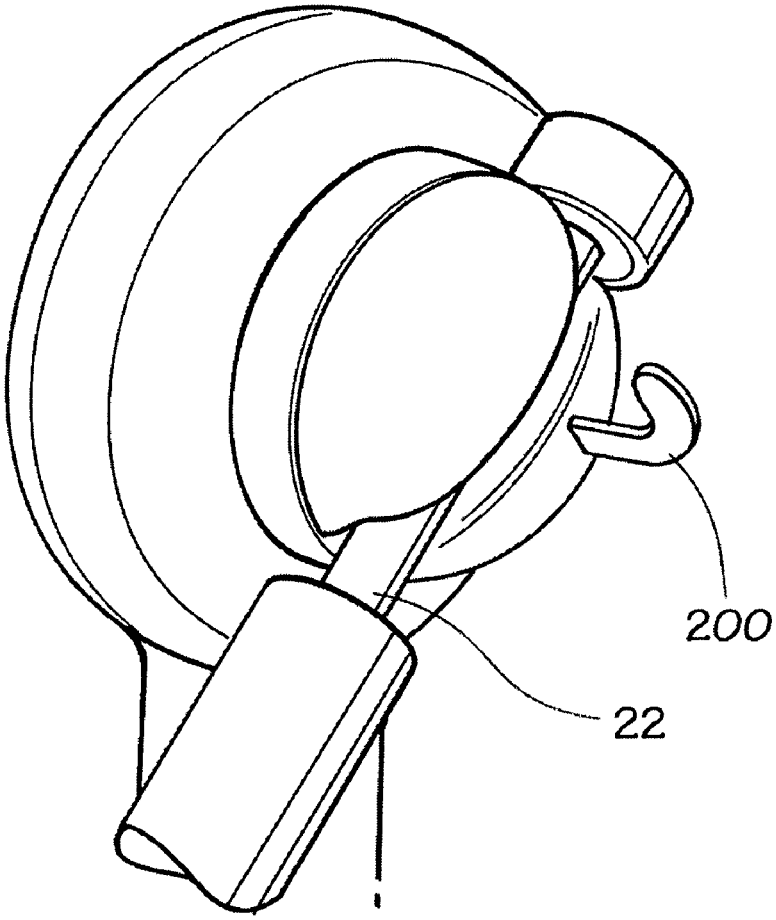
FIG. 20 is a perspective view of an alternate embodiment of a hub with a restraining hook.

FIG. 20 is an alternate embodiment of a hub that has a hook 200. The hook 200 captures the crank arm 22 when the arm is released from the hub.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. An apparatus that moves a jumping element, comprising:

a housing;

a motor attached to said housing;

a hub coupled to said motor and adapted to release the jumping element;

a deactivation element that is coupled to said hub and deactivates said motor when the jumping element is released from said hub; and, a strap that is coupled to the jumping device and said hub.

2. The apparatus of claim 1, wherein said deactivation element is a switch.

3. The apparatus of claim 1, wherein said hub includes a sliding collar that is coupled to the jumping element and said deactivation element.

4. The apparatus of claim 1, further comprising a crank arm that is coupled to said hub and the jumping element.

5. The apparatus of claim 4, wherein said hub includes a spring that exerts a force onto said crank arm.

6. The apparatus of claim 1, wherein said hub rotates the jumping element about a horizontal axis.

7. The apparatus of claim 1, wherein said hub rotates the jumping element about a vertical axis.

8. An apparatus that moves a jumping element, comprising:

a housing;

a motor attached to said housing;

a hub coupled to said motor and adapted to release the jumping element;

deactivation means for deactivating said motor when the jumping element is released from said hub; and, a strap that is coupled to the jumping device and said hub.

9. The apparatus of claim 8, wherein said deactivation means includes a switch.

10. The apparatus of claim 8, wherein said hub includes a sliding collar that is coupled to the jumping element and said deactivation means.

11. The apparatus of claim 8, further comprising a crank arm that is coupled to said hub and the jumping element.

12. The apparatus of claim 11, wherein said hub includes a spring that exerts a force onto said crank arm.

13. The apparatus of claim 8, wherein said hub rotates the jumping element about a horizontal axis.

14. The apparatus of claim 8, wherein said hub rotates the jumping element about a vertical axis.

15. A method for operating an apparatus that moves a jumping element, comprising:

activating a motor that moves a jumping element coupled to a hub;

releasing the jumping element from the hub;

sensing the releasing of the jumping element from the hub through movement of a slidable collar; and, deactivating the motor.

16. The method of claim 15, wherein the jumping element is rotated about a horizontal axis.

17. The method of claim 15, wherein the jumping element is rotated about a vertical axis.

18. The method of claim 15, further comprising selecting a speed of the motor.

19. The method of claim 15, further comprising selecting a time interval for activation of the motor.

20. An apparatus that moves a jumping element, comprising:

a housing;

a motor attached to said housing;

a hub coupled to said motor and adapted to release the jumping element; and, a strap coupled to said hub and the jumping element.

21. The apparatus of claim 20, further comprising a crank arm that is coupled to said hub and the jumping element.

22. The apparatus of claim 20, wherein said strap is attached to said crank arm and said hub.

23. A method for operating an apparatus that moves a jumping element, comprising:

activating a motor that moves a jumping element coupled to a hub;

releasing the jumping element from the hub; and, limiting a movement of the jumping element with a strap.

24. The method of claim 23, wherein the movement of the jumping element is limited by a strap.

25. An apparatus that moves a jumping element, comprising:

a housing;

a motor attached to said housing;

a hub coupled to said motor;

a crank arm coupled to said hub; and a hook that is attached to said hub and limits a movement of said crank arm.

26. The apparatus of claim 25, further comprises a deactivation element that is coupled to said hub and deactivates said motor when said crank arm is released from said hub.

27. An apparatus that moves a jumping element, comprising:

a housing;

a motor attached to said housing;

a hub coupled to said motor and adapted to release the jumping element;

a deactivation element that is coupled to said hub and deactivates said motor when the jumping element is released from said hub; and, a sliding collar that is coupled to the jumping device and said deactivation element.

28. The apparatus of claim 27, wherein said deactivation element is a switch.

29. The apparatus of claim 27, further comprising a strap that is coupled to the jumping device and said hub.

30. The apparatus of claim 27, further comprising a crank arm that is coupled to said hub and the jumping element.

31. The apparatus of claim 30, wherein said hub includes a spring that exerts a force onto said crank arm.

32. A method for operating an apparatus that moves a jumping element, comprising:

activating a motor that moves a jumping element coupled to a hub;

releasing the jumping element from the hub;

sensing the releasing of the jumping element from the hub through movement of a slidable collar; and, deactivating the motor.

33. A method for operating an apparatus that moves a jumping element, comprising:

activating a motor that moves a jumping element coupled to a hub;

releasing the jumping element from the hub; and, limiting a movement of the jumping element with a hook that is coupled to the hub.

34. The apparatus of claim 25, further comprising indicators that indicate a speed of said motor.

* * * * *